US006402411B2

(12) United States Patent
Spencer et al.

(10) Patent No.: US 6,402,411 B2
(45) **Date of Patent: *Jun. 11, 2002**

(54) FLUID DELIVERY SYSTEM

(75) Inventors: Jean L. Spencer, Boston; Crispin M. Miller, Lincoln; John M. Fritz, Hyde Park; John Thompson, Medfield, all of MA (US)

(73) Assignee: Berol Corporation, Freeport, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/455,700

(22) Filed: Dec. 7, 1999

Related U.S. Application Data

(63) Continuation of application No. 09/099,816, filed on Jun. 19, 1998, now Pat. No. 6,027,272.

(51) Int. Cl.[7] ..... B43K 5/04

(52) U.S. Cl. ..... 401/158; 401/152

(58) Field of Search ..... 401/158, 152, 401/156, 159, 161, 162, 163, 167, 165, 153, 143, 145, 146

(56) References Cited

U.S. PATENT DOCUMENTS

| | | | | |
|---|---|---|---|---|
| 1,870,853 A | | 8/1932 | Lassagne | 401/167 |
| 2,030,452 A | * | 2/1936 | Kingman | 401/162 |
| 2,263,299 A | | 11/1941 | Hanle | |
| 2,444,004 A | | 6/1948 | Chesler | |
| 3,000,355 A | | 9/1961 | Rosenthal | |
| 3,099,252 A | | 7/1963 | Cofield, Jr. | |
| 3,425,779 A | | 2/1969 | Fisher et al. | |
| 3,680,968 A | | 8/1972 | Schwartzman et al. | |
| 3,795,969 A | | 3/1974 | Tsunoda et al. | |
| 3,829,224 A | | 8/1974 | Kloosterhouse | |
| 4,017,870 A | | 4/1977 | Hubbard et al. | |
| 4,149,814 A | * | 4/1979 | Manwaring | 401/162 |
| 4,195,941 A | | 4/1980 | Barlow | |
| 4,552,477 A | | 11/1985 | Braithwaite et al. | |
| 4,572,691 A | | 2/1986 | Kirchhoff et al. | |
| 4,573,820 A | | 3/1986 | Kirchhoff | |
| 4,812,071 A | | 3/1989 | Batra et al. | |
| 4,917,521 A | | 4/1990 | Lai | |
| 4,923,317 A | | 5/1990 | Bishop et al. | |
| 5,154,523 A | | 10/1992 | Devreeze | |
| 5,169,037 A | | 12/1992 | Davies et al. | |
| 5,277,510 A | | 1/1994 | Okamoto et al. | |
| 5,468,082 A | | 11/1995 | Hori | |

FOREIGN PATENT DOCUMENTS

| | | |
|---|---|---|
| FR | 962 173 A | 6/1950 |
| FR | 1 015 449 A | 10/1952 |
| JP | 60-72283 | 5/1985 |
| JP | 8-266990 | 3/1990 |

* cited by examiner

*Primary Examiner*—David J. Walczak
(74) *Attorney, Agent, or Firm*—Marshall, Gerstein, & Borun

(57) ABSTRACT

A hand-held fluid delivery system includes a rigid body, a collapsible enclosure within the body, a fluid (e.g., correction fluid) within the enclosure, and a delivery end in communication with the collapsible enclosure. The delivery system preferably includes a spring that applies pressure to deliver fluid from the collapsible enclosure to the delivery end.

12 Claims, 4 Drawing Sheets

FLUID DELIVERY SYSTEM

CROSS REFERENCE TO RELATED APPLICATION

This application is a continuation of application Ser. No. 09/099,816, filed Jun. 19, 1998, now U.S. Pat. No. 6,027.272.

BACKGROUND OF THE INVENTION

This invention relates to fluid-delivery systems.

Chesler, U.S. Pat. No. 2,444,004 ("Chesler"), describes a writing instrument that includes a rigid body having a cavity, a sac within the cavity, and a ball mounted in a writing tip. The sac includes ink in fluid communication with the writing tip. The cavity further includes a spring that applies pressure to the sac to deliver ink to the writing tip. A rigid bar is positioned between the spring and the sac. According to Chesler (col. 3, lines 20–24):

The pressure exerted by the [spring/rigid bar] is substantially as great when the sac is nearly empty as when it is full, and it is therefore nearly uniform.

Chesler does not explain what he means by "nearly uniform." As will be demonstrated later, the pressure applied by the Chesler spring/rigid bar varies from when the sac is filled to when the sac is empty.

SUMMARY OF THE INVENTION

The invention relates to a hand-held fluid delivery system. The system includes a body defining a cavity, a collapsible enclosure within the cavity, and a fluid delivery end in communication with the enclosure. The enclosure includes a fluid such as a correction fluid, ink, glue, or cosmetic product (e.g., nail polish). In the preferred delivery system, the pressure on the fluid is sufficiently consistent that a user will not notice a change in the flow of the fluid from the delivery end during the normal usable life of the system. Moreover, the pressure on the fluid generally is not sensitive to changes in temperature. For example, the pressure on the fluid preferably will not change over a temperature change of 10° C. (or even 20° C.) within the range of 10° C. and 30° C. In addition, the preferred delivery system can deliver fluid to a substrate with consistent performance regardless of the orientation of the system and substrate with respect to gravity or in the absence of gravity.

There are a number of aspects to the invention. Four aspects relate to quantitatively defining the constant pressure on the fluid within the collapsible enclosure.

According to a first quantitative definition of constant pressure, the pressure on the fluid does not change more than 20% over at least a 1 ml decrease in the volume of fluid in the enclosure. Preferably, the pressure does not change more than 15%, and more preferably the pressure does not change more than 10%. In addition, preferably the pressure does not change over a 1.5 ml decrease or even a 2.0 ml decrease in the volume of the fluid.

According to a second quantitative definition of constant pressure, the enclosure includes at least 1 ml of fluid and the pressure on the fluid does not change more than 15% after a 50% decrease in volume of the fluid in the enclosure. Preferably, the pressure on the fluid does not change more than 10%, or even 7.5%. Moreover, preferably the pressure on the fluid does not change by these amounts even after a 60%, 70%, and 80% decrease in volume of the fluid in the enclosure.

According to a third quantitative definition of constant pressure, the enclosure includes at least 1 ml of fluid and the change in pressure on the fluid is less than 0.15 psi (preferably less than 0.10 psi) after a 50% decrease (preferably after a 60% or 65% decrease) in volume of the fluid in the enclosure.

And according to the fourth quantitative definition of constant pressure, the enclosure includes at least 1 ml of fluid and the slope of change in pressure in the fluid over change in volume of the fluid is approximately zero during delivery of at least 0.1 ml of fluid, and preferably during delivery of at least 0.2 ml, 0.3 ml, 0.4 ml, and 0.5 ml of fluid.

The hand-held delivery system preferably includes a mechanical element, like a spring (a deformable element that exerts a restoring force), that applies pressure to the collapsible enclosure to deliver fluid from the collapsible enclosure through the delivery end to a substrate. Five aspects of the invention relate to the spring.

In a first aspect of the invention relating to the spring, the pressure applied by the spring decreases less than 25% for a 1 ml decrease in volume of the fluid within the collapsible enclosure. Preferably, the pressure applied by the spring decreases even less (e.g., by less than 20%, 15%, or 10%) for a 1 ml decrease in volume of the fluid within the collapsible enclosure. Preferably, the pressure decreases by less than these amounts for a 1.5 ml or 2 ml decrease in volume of the fluid within the enclosure.

In a second aspect of the invention relating to the spring, the spring is configured to relax no more than 35% during use of the delivery system. The full relaxation of the spring is the difference between the spring position when the collapsible enclosure is fully loaded and the spring position when the spring is fully relaxed outside the pen. Spring position is measured at the point or position of the spring that works against the collapsible enclosure, often through an intervening element such as a shoe, and is measured in the same direction as the compression exerted on the collapsible enclosure. Preferably, the spring is configured to relax no more than 30%, and more preferably no more than 25% or no more than 20%, during use of the delivery system.

In a third aspect of the invention relating to the a spring that is generally arcuate in longitudinal section, the spring has two arms that make up the total length of the spring. This means that the arms are joined directly at a central point without an intervening segment. During use of a hand-held fluid delivery system including the spring, the pressure is applied to the collapsible enclosure by a central portion of the spring (preferably through a shoe).

In a fourth aspect of the invention relating to the spring, the spring again has two arms. Each arm has a free end, and each arm is generally tapered in width towards the free end. The tapered design assists in maintaining the most nearly constant pressure on the enclosure during dispensing of the deliverable fluid.

In a fifth aspect of the invention relating to the spring, the spring has an essentially uniform distribution of surface stress over most (greater than 80%) of the spring during use of the delivery system.

The hand-held delivery device including the spring also preferably includes a shoe between the spring and the collapsible enclosure. The shoe has a pressure applicator surface that contacts the enclosure, and in a further aspect of the invention the applicator surface has a beveled end towards the fluid delivery end. The beveled end helps maintain fluid communication between the enclosure and the delivery end as the enclosure collapses during use.

In another aspect of the invention, the collapsible enclosure includes a fusible portion that can be fused (e.g., heat fused) to the fluid delivery end to provide a stable fluid communication path. The enclosure may be composed of more than one layer, and when it is composed of more than one layer preferably the inner layer is composed of the fusible material.

The delivery tip may include a ball, a porous capillary tip, or the tip used with a poppet valve, as described, for example, in JP 62-29103, JP 62-35883, or JP 62-35884.

In another aspect of the invention, the delivery system includes a valve in the delivery end that seals the delivery end when the device is not in contact with a substrate. The valve may be, for example, a poppet valve, a spring-loaded ball, or a porous tip valve. An example of a porous tip valve is described in U.S. Pat No. 4,913,175, which is incorporated by reference. The valve preferably is a spring-loaded ball, such as described in WO 97/03845, U.S. Pat. No. 5,277,510, and U.S. Pat. No. 5,056,949, all of which are incorporated by reference.

The invention also relates to using the hand-held delivery system to deliver fluid to a substrate. The invention also relates to methods of producing the hand-held delivery system.

Fluid, as used herein, includes liquids and any other flowable compositions (e.g., gels and creams) that are capable of flowing under pressure from the collapsible enclosure through the delivery end to a substrate.

Other features and advantages of the invention will be apparent from the description of the preferred embodiment thereof, and from the claims.

DESCRIPTION OF THE PREFERRED EMBODIMENT

Figure 1:
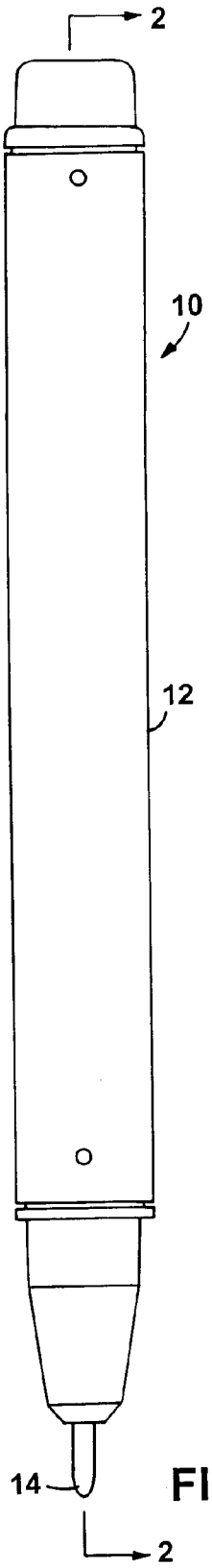
FIG. 1 is a side view of a hand-held delivery system.

Referring to FIG. 1, a hand-held fluid delivery system in the form of a correction pen 10 contains correction fluid for covering marks on a substrate such as paper. The correction pen has a graspable housing 12 and a ball point tip 14. In use, the ball point tip can be rolled against the substrate to apply a thin layer of correction fluid. The tip can be capped when not in use.

Figure 2:
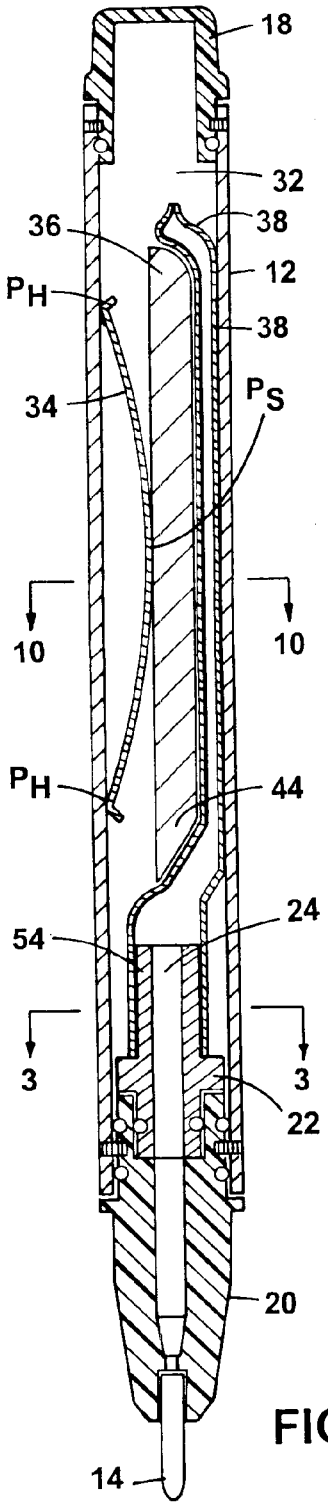
FIG. 2 is a cross-sectional view taken along line 2—2 in FIG. 1, except that the ball-point tip is not shown in cross-section.
Figure 3:
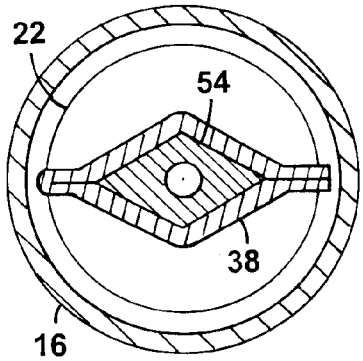
FIG. 3 is a cross-sectional view taken along line 3—3 in FIG. 2, with a diamond-shaped extension 54 used in place of the cylindrical extension 54 in FIG. 2.
Figure 4:
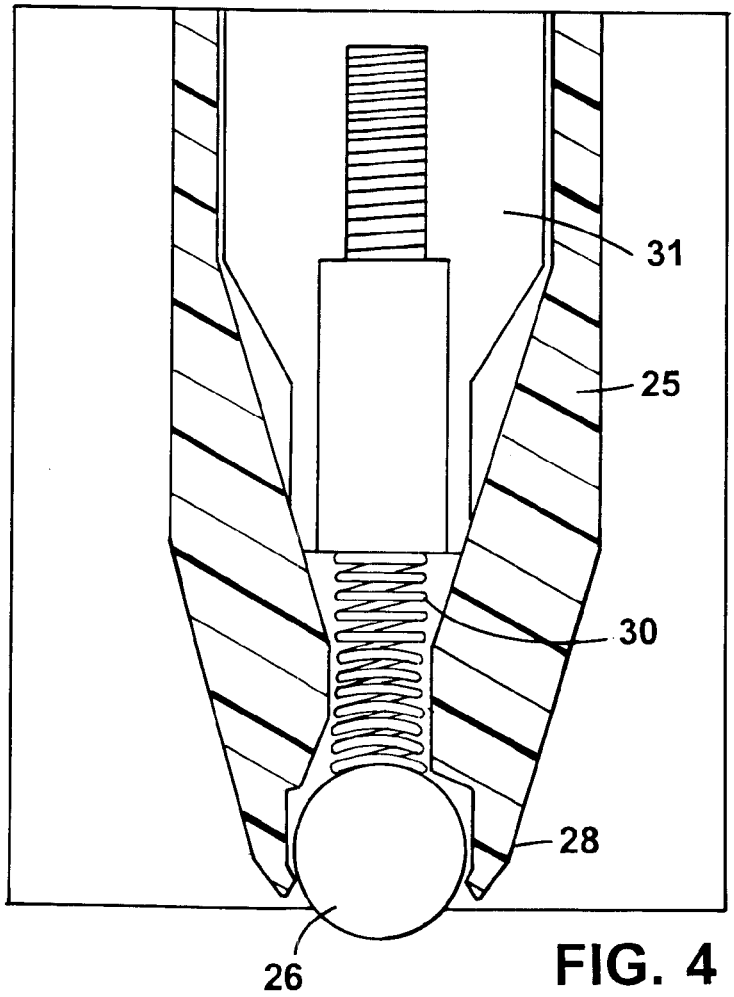
FIG. 4 is an enlarged section of the ball-tip assembly in FIG. 2, except that the spring 30 and support 31 are not shown in cross-section.

Referring to FIGS. 2–4, housing 12 consists of a rigid plastic tube fitted with end cover 18 and at the delivery end a molded plastic tip 20 containing insert 22 with an inner bore 24 for fluid communication with a ball point tip. Plastic tip 20 holds a ball-point tip 14, including a stainless steel tube 25, holding a 1.0 millimeter diameter, rotatable, tungsten carbide ball 26 contained at the outer end of the tube by a deformed outer lip 28 of steel tube 25. The ball could also have a diameter, for example, of 0.5 mm or 2.0 mm. The ball is spring-loaded in the tube using spring 30 and support 31. The spring-loaded ballpoint tip was obtained from Zebra Co., Ltd. (Tokyo, Japan).

Correction pen 10 includes a cavity 32, having a diameter of 0.42 inch, that includes spring 34, pressure shoe 36, and collapsible enclosure 38, The collapsible enclosure contains the correction fluid. Spring 34 is compressed between the inner surface of housing 12 and pressure shoe 36, which in turn bears against collapsible enclosure 38 to maintain the correction fluid in the enclosure at essentially constant pressure over the useful life of the correction pen. As the fluid is depleted, the spring is gradually relaxed. Spring 34 contacts housing 12 at points $P_h$ and shoe 36 at point $P_s$.

Spring

Figure 5:
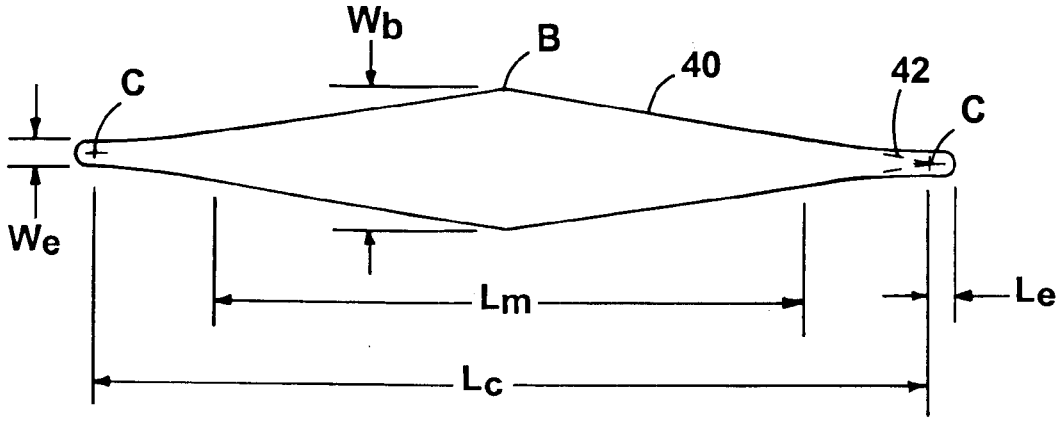
FIG. 5 is a plan view of a spring blank for forming the spring 34 in FIG. 2.

Referring to FIG. 5, unformed spring steel blank 40 is eventually formed into spring 34. The middle section of blank 40, having a length $L_m$ of 1.6 inches (about ⅔ of the overall length of the spring) is diamond-shaped, linearly decreasing in width from a base of width $W_b$ of 0.35 inch at point B where the spring will contact the shoe. The ends of the blank extend to a width $W_e$ of 0.063 inch at points C, corresponding to contact points $P_h$ and separated by a distance $L_c$ of about 2.25 inches. The distal tips of the blank extend another 0.08 inch ($L_e$) beyond points C, and may be radiused as shown.

As illustrated by dashed lines 42, lines defined by the straight sides of the middle section of the blank intersect at points C, such that the middle, diamond-shaped section of the spring, whose deformation provides for most of the deflection of the spring in use, has a stiffness that varies approximately linearly with distance from the housing contact points. Combined with the linear increase in bending moment along the spring from points C to point B, this linear stiffness increase causes the middle two-thirds of the spring (section $L_m$) to undergo approximately equal changes in curvature and also surface stress at all points during loading and relaxation. Thus, section $L_m$ of the spring relaxes uniformly as the fluid is dispensed so that every portion of $L_m$ contributes as much as possible to the change in overall shape. This helps to maximize the distance between the relaxed state and the full-collapsible-enclosure deflected state for any limiting value of stress sustainable within the spring material.

In addition, since the curvature changes uniformly, if section $L_m$ is originally formed as a circular arc (as in FIG. 6), during the operation of the pen it will continue to have the shape of a circular arc, whose curvature varies over time as the pen is emptied but whose curvature is spatially uniform at any given time. This arcuate shape of section $L_m$ will cause the spring to remain tangent to shoe 36 always at only the single central point $P_s$ so that the free length of either arm of the spring remains constant, preferably at the maximum possible length, as the fluid is delivered (rather than having some of the length of each arm initially resting on shoe 36 and later standing free of it). The arms make up the entire length of the spring because they are joined at a single central point and not through an intervening segment. Maintaining the acting (free) length of the arms at a constant maximum value provides a uniform and maximal effective compliance of the spring and thereby helps to minimize variation in spring force and fluid pressure as the fluid is expended and the spring relaxes.

The spring can be made from any material capable of undergoing the range of curvatures described below, at the required levels of force, without yielding. In the prototype the spring was made from flat tempered blue steel shim stock 0.008 inch thick. The required tapered-armed shape was cut from sheet stock, then was curved by bending around a mandrel, and formed into a tight recurve of approximately 90° at each tip, and finally heated 30 minutes at 500° F. (260° C.) to minimize residual stresses.

Figure 6:
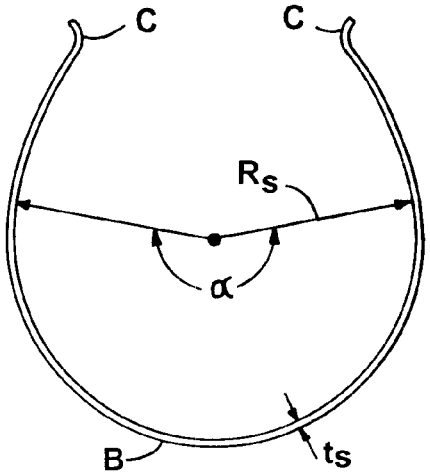
FIG. 6 is a side view of the spring in FIG. 5, as formed.

As shown in FIG. 6, after being formed and heat-treated and in its relaxed state, the middle portion of spring 34 (the diamond-shaped portion) follows an arc of radius $R_s$ of about 0.43 inch with an included angle $\alpha$ of about 200 degrees. The distal tips of the spring are curved outward to expose points C to bear against the correction pen housing. The spring has a thickness $t_s$ of 0.008 inch.

Figure 7:
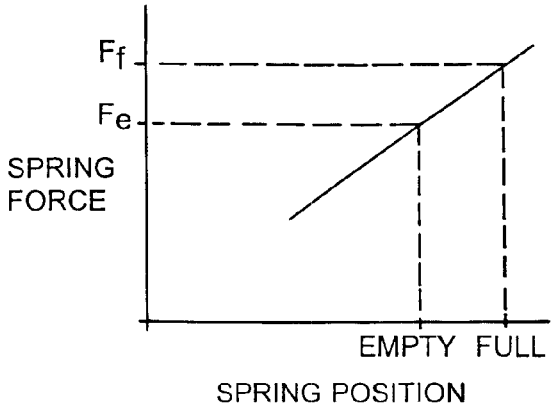
FIG. 7 illustrates the linearity of the force of the spring in FIG. 6 in use.

Referring also to FIG. 7, spring 34 preferably is configured to relax no more than to 35% (more preferably, no more than about 30%, 25%, or 20%) during use of the pen.

Shoe

Shoe 36 is composed of a molded plastic (e.g., glass-fiber-filled polypropylene) and has a length of 2.2 inches, and a thickness of 0.125 inch. Alternatively, the shoe can be made from, for example, aluminum rod stock, milled flat on one side and formed with a file at the ends. End 44 is beveled to avoid impeding the flow of correction fluid from the collapsible enclosure to channel 24 in insert 22; channel 24 leads to the ball-tip.

Figure 8:
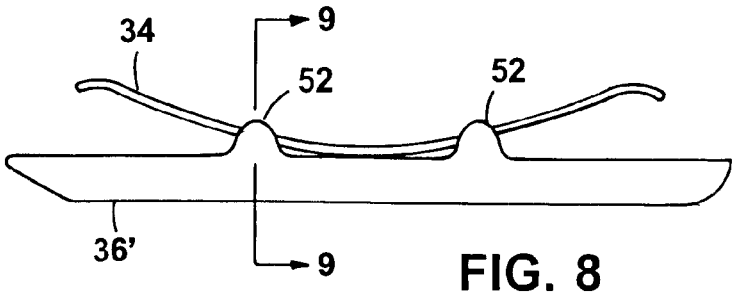
FIG. 8 is a side view of an alternative shoe construction.
Figure 9:
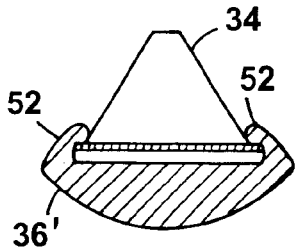
FIG. 9 is a cross-sectional view, taken along 9—9 of FIG. 8.

Referring to FIGS. 8 and 9, an alternative construction for shoe 36 (labelled 36') has a flat surface for loading against spring 34, and two pairs of opposing, spring-retaining fingers 52 extending from the surface for holding spring 34 in a partially compressed state for assembly.

Collapsible Enclosure

Collapsible enclosure 38 may be composed of one or more layers. A preferred enclosure includes an inner layer that is heat fusible to insert 22 (or other appropriate attachment point in the delivery end) and an outer layer that functions as a barrier to the vapor of any volatile solvents in the fluid within the enclosure. The inner layer also should be compatible with the correction fluid.

The wall of the collapsible enclosure generally should be thin enough to collapse smoothly and completely, but not so thin that it tears easily. The wall of the enclosure may have a thickness, for example, of between 0.001 inch and 0.0025 inch.

An example of a two-layer film that can be used is polyethylene/aluminized polyester, which has a thickness of 0.0017 inch and was obtained from Scharr Industries, Inc. (Bloomfield, Conn.) (48 gauge metallized polyester laminated to 1.25 mil low density polyethylene). Examples of heat fusible materials for the inner layer are polyethylene, ethylene-vinyl acetate copolymer (EVA), ethylene-acrylic acid copolymer (EAA), ionomer (ethylene-methacrylate acid salts), and modified polypropylene. Examples of gas-barrier materials for the outer layer include metallized polymers such as polyester, polypropylene, and nylon, with a thin deposited metal layer, usually aluminum. Gas-barrier layers could also be foils and polymers such as poly (vinylidene chloride) copolymer (PVDC).

The collapsible fluid enclosure was fabricated from flat sheet stock (1.5"×3.50"), one surface of which, if folded to face itself, can be thermally welded. The enclosure was made from a rectangle of this material by folding it lengthwise and heat-seaming it along the open side and across one end. The piece of material was sized to give the finished and installed enclosure the same diameter as the interior of the barrel, and a free length about one diameter longer than the pressure shoe. Before seaming the end was pleated into four radial folds which were then seamed obliquely, so that, when filled, the end of the enclosure is pyramidal.

Correction Fluids

Correction fluid generally refers to a fluid that can be applied to an erroneous marking on paper to obscure the marking. Correction fluids typically harden sufficiently within minutes to receive a corrective marking.

A correction fluid generally includes an opacifying agent such as titanium dioxide, a film-forming polymer, and a carrier liquid (organic solvent and/or water). A preferred correction fluid formulation is provided below:

| Component Function | Component Name | Supplier | Weight % |
|---|---|---|---|
| Solvent | Methylcyclohexane | Phillipe | 34.67 |
| Pigment | Titanium dioxide R-931 | Dupont | 39.28 |
| Binder | Pliolite VT 40 wt % in MCH | Goodyear | 19.87 |
| Dispersing Resin | SB Acrylic B-67 45 wt % in mineral spirits | Rohm & Haas | 4.365 |
| Plasticizer | Jayflex DTDP | Exxon | 1.626 |
| Fragrance | Fragrance 759292/D60218S | Haarmann & Reimer | 0.022 |
| Colorant | Lamp black 866-9907 in solvent mixture* | Huls | 0.051 |
| Denaturant | Allyl Isothiocyanate | Aldrich | 0.120 |
| Total Rounded Weight % | | | 100.00 |

*Solvent mixture of mineral spirits, n-butanol, isobutanol, xylene.

The correction fluid was made according to the following procedure:

1. Clean a one-liter paint container and lid with solvent; dry thoroughly.
2. Obtain a tare weight on the paint can and lid.
3. Weigh the methylcyclohexane (MCH) into the container.
4. Weigh the dispersant or dispersing resin into the container.
5. Weigh 20 weight percent of the total Pliolite VT resin solution into the container.
6. Cap the container and mix the solution by hand-shaking or on a paint shaker for 5 to 10 minutes if the contents are slow to dissolve.
7. Weigh the titanium dioxide ($TiO_2$) pigment; add slowly to the container under stirring on a Cowles disperser (Indco, Inc., New Albany, Ind.).
8. Under mixing with the Cowles disperser, slowly add the remainder of the Pliolite VT resin solution.
9. Add the Jayflex plasticizer to the fluid under mixing.
10. Mix the fluid under high shear for 30 minutes.
11. Add 180 grams of pre-washed 1.0–1.25 mm zirconia silica beads (Glen Mills Inc., Clifton, N.J.) to the container (beads must be pre-washed with MCH and thoroughly dried).
12. Agitate container on paint shaker for 2 hours.

13. Filter fluid through a paint filter into a pre-weighed one-liter, Nalgene container.
14. Weigh the container and determine the weight of fluid; calculate the amounts of fragrance, colorant, and denaturant to add to the fluid.
15. Weigh the appropriate amounts of fragrance, colorant, and denaturant; add to the container.
16. Agitate on paint shaker for 15 minutes.

The resulting correction fluid had a viscosity of 200 cps at 100 $sec^{-1}$ using a Carri-Med rheometer (TA Instruments, New Castle, Del.).

Other Fluids

The delivery system can also be used to deliver, for example, inks, glues, and cosmetic products.

Inks used in the delivery system are capable of making an appropriate mark on a selected substrate (e.g., paper, whiteboard, OHP film, or even metal or glass). The ink may be erasable or non-erasable. The ink typically will contain a colorant (dye or pigment) and a carrier liquid (organic solvent and/or water). When the ink contains a pigment, it also often will include a dispersing agent. The ink may have a viscosity, for example, of between 2 cps and 200,000 cps, as measured at 25° on a Brookfield viscometer (Brookfield Engineering Laboratories, Inc., Stoughton, Mass.; or a Carri-Med rheometer).

Glues are used to adhere surfaces together, and generally include an adhesive and a carrier liquid.

Cosmetic products include nail polish, lipstick, eye liner, and rouge. Nail polish may include, for example, a colorant, a film-forming polymer that will develop a film on nails, and a carrier liquid.

The hand-held delivery system also may be used to apply deodorant, antiperspirant, or other toiletry products like toothpaste.

Assembly

The correction fluid pen can be assembled as follows.

The inner end of insert 22 could have a molded extension 54 (see FIG. 3) for attachment to the open end of the collapsible enclosure 38. The attachment preferably is done in production by making the enclosure and the lining layer of the enclosure of compatibly weldable materials (e.g., polyolefins) and thermally or ultrasonically fusing them together. A diamond-shaped cross section of the extension, like the extension illustrated in FIG. 3, could facilitate such a joining process, since the front end of an enclosure made by the folding procedure is a flat shape and also may have excess width to either side of the fitting; if the diamond-section extension is inserted into such a fabrication, the resulting joint can then be sealed by a simple press, closing along a single direction, and any margins of material extending to either side beyond the fitting can be sealed shut in the same pressing step.

If extension 54 and the collapsible enclosure are not composed of compatibly weldable materials, the joint can be sealed by mechanical compression. This was done in prototypes by making the extension surface cylindrical and using circular bindings to compress the enclosure tightly against the extension with a compliant gasket material in between. For example, the joint could include a gasket layer of several windings of Teflon® plumber's tape around the extension, the enclosure bound on with fine wire fastened by twisting. Alternatively, a rubber "O-ring" was used as the gasket layer and the enclosure bound on with several turns of Spectra® braided fishing line, wound tightly both below and above the gasket so as to stretch the enclosure material tightly over the gasket, with the windings fixed in place by a layer of epoxy cement.

During assembly, the spring, pressure shoe, and enclosure are maintained in proper alignment both laterally and longitudinally.

Laterally, in order for the shoe to compress the enclosure fully, the three parts are centered on a common midplane running longitudinally. In addition, the shoe is oriented parallel to the barrel. The enclosure and the spring have this orientation automatically, as a consequence of their shape and surroundings.

Longitudinally, the shoe is located suitably with respect to the enclosure so as to compress the enclosure without being too near either end (where it would encounter some degree of obstruction from the enclosure ends' resistance to deformation). In addition, the spring is located with respect to the shoe so that its resultant force impinges the mid-length point of the shoe, in order for both ends of the shoe to compress the enclosure in a balanced manner.

In correction pen 10, the alignment of the shoe with respect to the enclosure was maintained by using a low-strength adhesive between them, and the alignment of the spring with respect to the shoe and enclosure was accomplished by careful assembly, and was maintained by friction between the spring-loaded parts.

It may be preferable to insert all three internal parts—spring, shoe, and enclosure—into the barrel at once, as a package, from the same end of the barrel. However, for correction pen 10, the assembly went through two steps.

First, the shoe was mounted to the surface of the enclosure using a backingless version of the adhesive commonly used on transparent tape. The shoe was located directly opposite the seam, to avoid having the seam present along either side of the shoe where it would interfere with the rolling action of the enclosure membrane as the shoe progressively indents the upper face of the enclosure. A flexible handling tab was attached to the shoe. The tab was a short piece of non-adhesive tape, as wide as the shoe and long enough to extend out the back of the barrel and be gripped by hand there.

Insert 22 was installed in the enclosure as described above and also was installed into tip 20, and the combination of enclosure and shoe was then slid in from the front end of the barrel until tip 20 was seated in the barrel.

When the enclosure and shoe were in place in the barrel, the spring was slid in from the rear of the barrel—in the process, being compressed into a form sufficiently straight to fit into the space between shoe and barrel—while the shoe was restrained by its handling tab to prevent frictional contact with the spring from displacing it forward. The position for the spring was determined by connecting tip 20 of such an assembly filled with water and installed in housing 12, to a syringe, so that the enclosure could be repeatedly emptied and filled; the spring position was adjusted until both ends of the shoe compressed the enclosure at the same rate.

Alternatively, the enclosure, shoe, and spring can be inserted as one package, nested, for example, in a partial-cylindrical shell or cradle of some kind, to enable the enclosure to be slid into the barrel despite having the pressure of the spring already applied to it.

The assembled body was filled with fluid by a suction technique. With ball tip 14 not yet installed, a tubing fitting was installed at the rear of the barrel, with an airtight joint, and connected to a pressure/vacuum sensor and a suction syringe. With the end of plastic tip 20 immersed in a supply of correction fluid, a partial vacuum (a pressure decrease of about 5 psi) was applied by the syringe. The fluid entered the enclosure and expanded it, compressing the spring and filling the enclosure with fluid. The small amount of air present (initially occupying the dead spaces in the fluid path and in the periphery of the collapsible enclosure) can be purged if desired by turning plastic tip 20 upward and partially releasing the vacuum so that the spring begins to compress the enclosure and expels the air, and then repeating the filling procedure. Once the enclosure is satisfactorily filled, the ball tip is installed on plastic tip 20 and end cap 18 is installed to close the back of the barrel. The end cap is not airtight.

Figure 11:
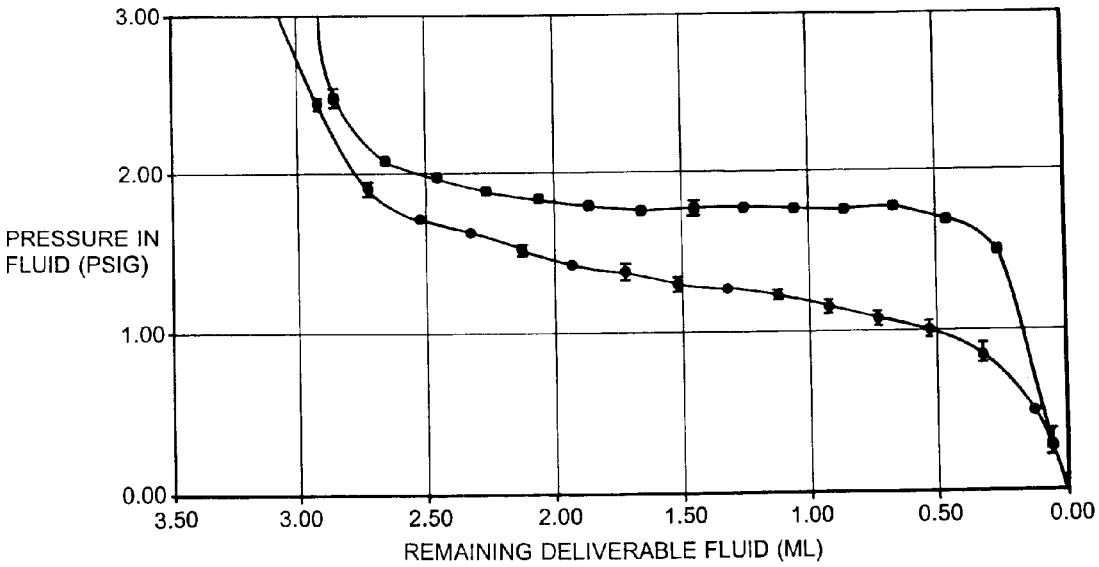
FIG. 11 illustrates the variation in fluid pressure as a function of fluid volume in the enclosure in the device in FIG. 2, in comparison to the variation obtained with a Chesler-type spring.

Using this relatively high level of suction, the enclosure may be somewhat overfilled (i.e., filled to a point somewhere above the optimum region of the pressure-volume curve in FIG. 11); pens filled in this manner were therefore run for a few meters (typically 0.75 to 2.25) on a delivery-testing machine until their rate of delivery came down into the desirable range.

Alternatively, suction can be applied to the rear of the barrel to draw the enclosure open, with plastic tip 20 facing upward, so that the enclosure initially fills with air, and then, while holding the suction, the fluid can be introduced with a spout that extends through passage 24 into the enclosure directly while allowing the displaced air to exit up the passage 24 alongside the outside of the filling spout. This avoids dipping plastic tip 20 in fluid, and also displaces the interior air in a single filling procedure. A similar but quicker option, if some amount of interior air is acceptable, is to start with the enclosure collapsed and insert a short, larger filling spout that exactly fits the opening in plastic tip 20, and then apply the suction as for the dipping method.

Also alternatively, if the enclosure, shoe, and spring are installed as a pre-assembled package as previously described, it may be preferable to fill the enclosure before installing this assembly.

Use

Correction pen 10 can be used to apply correction fluid over erroneous markings on paper by passing the ball-point over the marking.

Figure 10:
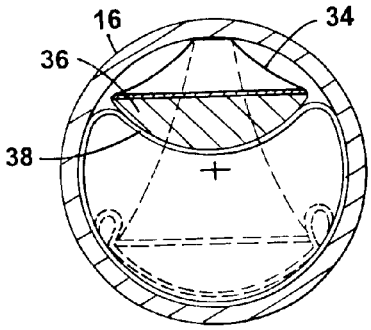
FIG. 10 is a transverse cross-section of the pen in FIG. 2, taken along line 10—10 in FIG. 2.

Referring to FIG. 10, the cross-section of correction pen 10 illustrates the progression of shoe 36 as spring 34 is progressively relaxed as the fluid is depleted. The spring, shoe, and enclosure 38 are shown in solid lines in their original condition, with the enclosure full of fluid.

FIG. 11 provides a comparison of the pressure maintained on the correction fluid within the enclosure when using spring 34 and when using a Chesler-style spring, as the volume of deliverable fluid in the enclosure is depleted. Pressures were measured for pens whose fluid enclosures were filled with water, with readings taken as the water was delivered slowly into a syringe that had volumetric markings. Pressure was detected by including in the syringe connection an electronic pressure transducer (Px26-015 DV from Omega Engineering, Stamford, Conn.), previously calibrated against a mercury manometer, and supplied with a regulated 10-volt excitation and read with a digital voltmeter. The normal capacity of enclosure 38 when used with spring 34 is about 2 ml; as described previously the enclosure may be overfilled during assembly resulting in an undesirable initial rate of delivery (resulting from higher pressure, as demonstrated around the first data point for spring 34) that quickly levels off to the desired level when the excess fluid is removed.

The results in FIG. 11 demonstrate that with the correction pen 20 operating in the relatively flat region of the plot, which encompasses most of the deliverable fluid, the pressure on the fluid does not change much, well less than 20% in delivering, for example, 1 ml of fluid. Similarly, the pressure on the fluid changes well less than 15% during a 50% decrease in the volume of fluid in the enclosure. The change in pressure on the fluid is less than 0.15 psi after a 50% decrease in volume of the fluid. Finally, the slope of change in pressure over change in volume is approximately zero in the flat region.

In contrast, the Chesler-type spring performed poorly in comparison.

The relatively flat region of the plot in FIG. 11 results from more than just the design of spring 34. While spring 34 has good linearity and compliance, its force to some extent decreases as the spring relaxes. The additional effect that compensates for-this decrease, so as to hold the fluid pressure constant, comes from the geometric behavior of the collapsible fluid enclosure 38 as it interacts with the descending shoe 36 and the surrounding barrel 16.

As shown in FIG. 10, as the enclosure is compressed two small convex regions of it bulge out from under the shoe on either side, forming "ears" in a cross-section view such as the one shown. As the shoe converts the spring force to fluid pressure by distributing the force over a certain effective area of the enclosure (analogous to the area of a piston face, in a pump made of rigid components), the width of this effective area will vary according to the size and position of the "ears." Specifically, the width of the effective area will be equal to the distance between the highest points of the "ears" (i.e., the points at which the tangent to the curvature of each "ear" is perpendicular to the direction of the force exerted by the spring). The portion of the enclosure membrane between these points is an effective-piston "free body" that transmits to the fluid a force exactly equal to the spring force, since the tension transmitted by the membrane across the boundary points, being perpendicular to the spring force, can exert no component in the direction of the spring force so as to modify that force's magnitude.

As the shoe descends, the "ears" increase in size. During the initial portion of the descent, the space available for them between the shoe and barrel also increases. However, by the time the shoe has reached the mid-level of the barrel the "ears" are enlarging faster than the clearance between shoe and barrel, and after this point the clearance is actually decreasing. Consequently during these latter phases the "ears" are progressively crowded inward so that the effective shoe area (i.e., the effective force-to-pressure-conversion area) progressively decreases, so as to compensate for the decrease in spring force that is occurring at the same time.

The pressure-leveling effect could be implemented over a greater portion of the stroke, so as to extend the strictly level portion of the curve, by modifying the interior shape of barrel 16 so as to crowd the "ears" inward at a constant rate over a greater portion of the stroke.

Other embodiments are within the claims. For example, the spring could be a rotary spring that, for example, applies pressure by twisting the enclosure.

What is claimed is:

1. A hand-held fluid delivery system, comprising a rigid body including a cavity;

a collapsible enclosure within the cavity;

a fluid within the collapsible enclosure;

a fluid delivery end in communication with the collapsible enclosure; and a spring within the cavity that applies continuous pressure on the collapsible enclosure to deliver fluid from the collapsible enclosure through the delivery end to a substrate, wherein the spring has two curved free arms joined at a central point without an intervening segment, the two free arms making up an entire effective length of the spring, the effective length being generally arcuate in longitudinal section.

2. The hand-held fluid delivery system of claim 1, wherein the fluid is a correction fluid.

3. The hand-held fluid delivery system of claim 2, wherein the correction fluid within the collapsible enclosure is under pressure during use of the delivery system to deliver correction fluid from the collapsible enclosure through the delivery end to a substrate, the pressure being sufficiently consistent that a normal user of the delivery system will not notice any substantial change in the flow of the correction fluid to the substrate during normal usable life of the delivery system over a 10° C. temperature change between 10° C. and 30° C.

4. The hand-held fluid delivery system of claim 1, wherein the spring has an essentially uniform distribution of surface stress over greater than 80% of the spring during use of the delivery system.

5. The hand-held fluid delivery system of claim 1, wherein the spring is configured to relax no more than 35% during use of the delivery system.

6. The hand-held fluid delivery system of claim 1, wherein the pressure applied by the spring decreases less than 25% for a 1 ml decrease in volume of the fluid within the collapsible enclosure.

7. The hand-held fluid delivery system of claim 1, wherein the pressure on the fluid does not change more than 20% over at least a 1 ml decrease in volume of the fluid in the collapsible enclosure over a 10° C. temperature change between 10° C. and 30° C.

8. The hand-held fluid delivery system of claim 1, wherein the change in pressure on the fluid in the collapsible enclosure is less than 0.15 psi after a 50% decrease in volume of the fluid in the collapsible enclosure.

9. The hand-held fluid delivery system of claim 1, wherein the slope of the change in pressure on the fluid in the collapsible enclosure over the change in volume of the fluid in the collapsible enclosure is approximately zero during delivery of at least 0.1 ml of the fluid in the collapsible enclosure over a 10° C. temperature change between 10° C. and 30° C.

10. The hand-held fluid delivery system of claim 1, further including a lengthwise-extending shoe between the spring and the collapsible enclosure, having a pressure applicator surface with a beveled end portion towards the fluid delivery end of the delivery system.

11. The hand-held fluid delivery system of claim 1, wherein the collapsible enclosure includes an inner layer and an outer layer, the inner layer being fused to the fluid delivery end.

12. A method of applying a correction fluid to a substrate, comprising:

applying continuous pressure with a spring to a collapsible enclosure containing a correction fluid within a rigid body to cause the correction fluid to pass from the collapsible enclosure through a fluid delivery end and onto the substrate;

wherein the spring has two curved free arms joined at a central point without an intervening segment, the two free arms making up an entire effective length of the spring, the effective length being generally arcuate in longitudinal section.

* * * * *